United States Patent [19]

Walter et al.

[11] 3,999,663

[45] Dec. 28, 1976

[54] FRAME FOR SUSPENDED FILE FOLDERS

[76] Inventors: Erhard P. Walter, 236 Godsell Ave.; Wesley R. Snowden, 34 Wimbleton Road, both of Toronto, Ontario, Canada

[22] Filed: Mar. 18, 1976

[21] Appl. No.: 668,123

[30] Foreign Application Priority Data

Apr. 14, 1975 Canada ..... 224530

[52] U.S. Cl. ..... 211/175; 211/46; 211/184; 211/189; 248/DIG. 9; 312/184; 403/107

[51] Int. Cl.[2] ..... B42F 17/08

[58] Field of Search ..... 211/175, 189, 162, 206, 211/184, 45, 46; 312/184; 248/DIG. 9, 298, 286, 287; 403/107, 108, 329

[56] References Cited

UNITED STATES PATENTS

| | | | |
|---|---|---|---|
| 642,561 | 1/1900 | Phillips | 211/175 |
| 2,120,748 | 6/1938 | Harris | 403/107 X |
| 2,336,802 | 12/1943 | Posner | 211/45 X |
| 2,810,388 | 10/1957 | Conley et al. | 248/DIG. 9 |
| 2,871,861 | 2/1959 | Posner | 211/162 |
| 3,098,488 | 7/1963 | Schnelle | 211/46 X |
| 3,266,496 | 8/1966 | West et al. | 211/46 X |
| 3,425,756 | 2/1969 | Hubbard | 403/107 X |
| 3,853,227 | 12/1974 | Filipowski | 312/184 X |
| 3,860,119 | 1/1975 | Irvine et al. | 211/175 X |
| 3,871,039 | 3/1975 | Garceau et al. | 403/107 X |

FOREIGN PATENTS OR APPLICATIONS

| | | | |
|---|---|---|---|
| 641,151 | 5/1962 | Canada | 312/184 |

*Primary Examiner*—James T. McCall
*Assistant Examiner*—Robert W. Gibson, Jr.

[57] ABSTRACT

A frame for hanging file folders is adjustable both longitudinally and laterally. Longitudinal rails for suspending the folders are in detented engagement with through sockets in side members of end frames, the side members of the end frames being connected by telescopic cross members.

2 Claims, 5 Drawing Figures

FRAME FOR SUSPENDED FILE FOLDERS

FIELD OF THE INVENTION

This invention relates to frames for supporting hanging file folders.

REVIEW OF THE PRIOR ART

A commonly used filing system employs folders or pockets suspended from and between spaced parallel rails, these rails often being provided as part of a framework which can be inserted into a drawer of a filing cabinet to adapt it for this form of filing. Such frames comprise the rails from which the folders are hung extending between supporting end frames.

Because of variations in the dimensions of filing cabinet drawers, and because of the different widths of folder which may be employed, a number of different types of frame are required. Alternatively, frames have been provided which can be assembled to different dimensions, but in these cases assembly of the frames to appropriate dimensions has been a tedious and time consuming task, involving the provision of loose hardware such as nuts and bolts; a typical example of such a frame is shown in U.S. Pat. No. 2,278,403 to Jonas.

Other frames have been proposed which are adjustable in length, but these have all required separate or screw connected clamping members such as shown in U.S. Pat. Nos. 3,295,697 (Patterson), 3,356,228 (Woodhouse) and 3,860,119 (Irvine et al).

SUMMARY OF THE INVENTION

The object of the present invention is to provide a frame for hanging file folders which is easily assembled and readily adapted to different widths of folder or dimensions of filing cabinet drawer, and which is formed by a minimum of separate parts.

According to the invention, a frame for supporting hanging file folders comprises two laterally spaced longitudinal rails, two longitudinally spaced end frames each comprising laterally spaced legs and at least one telescopic cross member connecting the legs, and push through sockets associated with each leg and each receiving an end of one of the longitudinal rails. Preferably the sockets comprise spring means engagable with any one of a plurality of detents formed in end portions of the rails. Preferably also these end portions of the rails are weakened at points intermediate the detents whereby portions of the rails may be broken away in order to shorten the latter. Preferably also, the telescopic cross members comprise mutually slidable bars integral with each of the associated spaced legs, the slidable bars being capable of assuming at least two different detented relationships whereby to vary the width of the frame.

SHORT DESCRIPTION OF THE DRAWINGS

A preferred embodiment of the invention is described with reference to the accompanying drawing, in which.

DESCRIPTION OF THE PREFERRED EMBODIMENT

Figure 4:
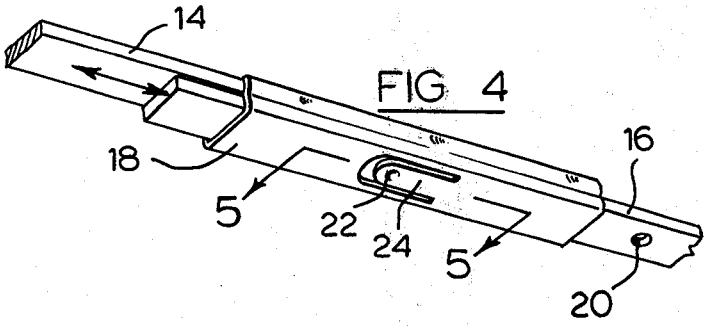
FIG. 4 is a detail on an enlarged scale of part of a cross member of the frame shown in FIG. 1.
Figure 5:
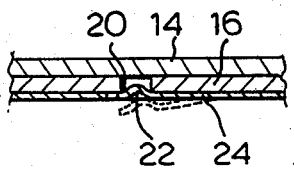
FIG. 5 is a cross-section on the line 5—5 in FIG. 4.

The frame shown in the drawing comprises longitudinal rails 2 and end frames 4, the end frames each being formed by two mutually engagable parts 6 and 8. Each part 6 and 8 comprises a leg portion 10 having a foot 12, and a cross member portion 14 or 16. A sleeve 18 is welded to each portion 14 to form a socket into which a portion 16 may slide (see FIG. 4). The portions 16 are drilled with spaced holes 20 engagable by a detent 22 formed on a spring blade 24 integral with the sleeve 18. The portions 14 and 16 co-operate to form telescoping cross members, the member 16 being movable relative to the members 14 so that the detents 22 may engage different ones of the drillings 20, thus setting the width of the frames 4 at different values. A further detent may be provided if desired to prevent total disengagement of portions 14 and 16 one from the other.

Figure 1:
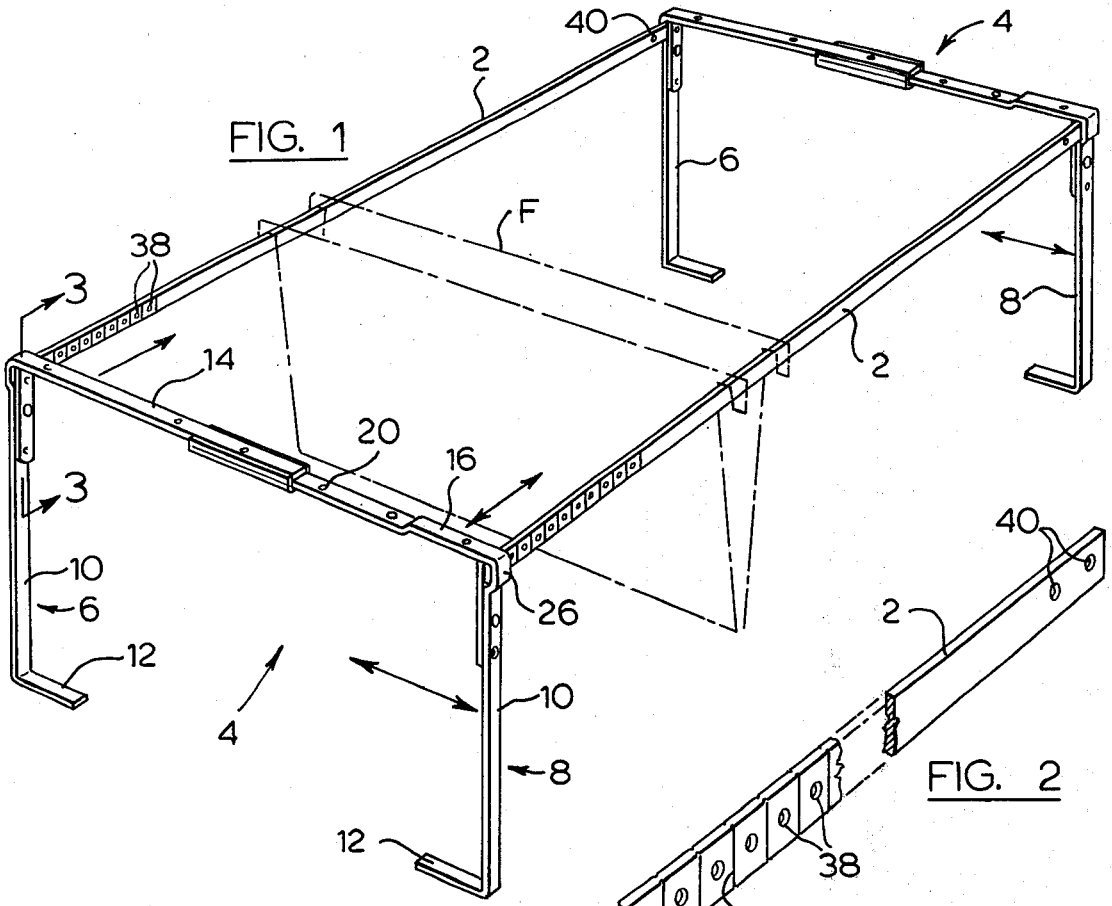
FIG. 1 is a perspective view of a frame in accordance with the invention.
Figure 2:
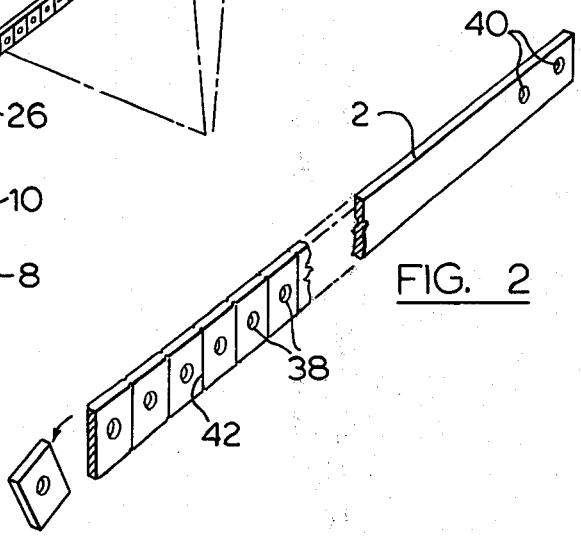
FIG. 2 shows on an enlarged scale a portion of one of the longitudinal rails of the frame.
Figure 3:
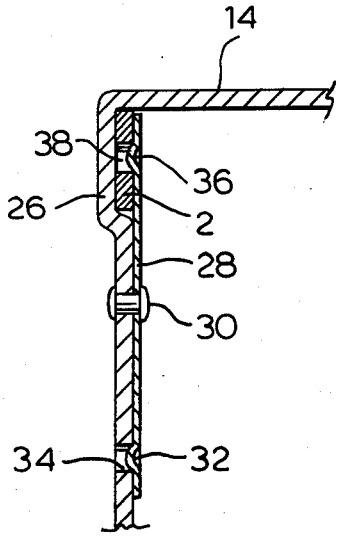
FIG. 3 is a cross-section on an enlarged scale on the line 3—3 in FIG. 1.

Adjacent their points of juncture with the portions 14 and 16, the legs 10 are provided with jogs 26 which co-operate with the cross member portions and with spring tongues 28 substantially bridging the jogs to form through sockets snugly receiving the ends of the longitudinal rails 2 (see FIG. 3). The spring blades 28 are secured to the legs beneath the jogs by rivets 30 and located by indents 32 engaging drillings 34 in the legs 10. Indents 36 in the tongues enter detents 38 in the form of drillings in the members 2 so as to locate the latter relative to the end frames 4. At the one ends of the members 2, a number of spaced drillings 38 are provided, whilst at the other ends two drillings 40 are provided, with a spacing different from that between the drillings at the other end of the rail (typically 1½ times the spacing). This arrangement enables the length of the rails between the frames 4 to be adjusted in increments of half the distance between successive drillings 38. In order to avoid unwanted projection of the rails beyond the frames 4, the rails are grooved on either side between the drillings 38 to provide lines of weakness along which superfluous portions of the rails 2 may be broken away, as best seen in FIG. 2.

In use, the frame is readily assembled by interengaging the parts 6 and 8 by pushing the portion 16 into the sockets provided by the sleeve 18, and pressing the ends of the longitudinal rails 2 into the sockets formed by the jogs 26. The frame may then readily be set to any desired dimensions utilizing the detenting action of the various drillings, whereupon it is ready to receive files F. If required in order to accommodate the frame in a filing cabinet drawer, projecting ends of the rails 2 are broken away at the grooves 42.

What we claim is:

1. A frame for supporting hanging file folders comprising two laterally spaced longitudinal rails, two longitudinally spaced end frames each comprising two laterally spaced legs and a cross member connecting the tops of the legs, and push through sockets associated with each leg, each said socket receiving an end of one of the longitudinal rails, wherein the sockets comprise jogs in said legs adjacent their points of juncture with the cross members, said jogs cooperating with the cross members to provide recesses snugly receiving the ends of the longitudinal rails, and spring means each engagable with one of a plurality of detents formed in end portions of the rails, said spring means being spring blades substantially bridging the recesses defined by said jogs and secured to the legs beneath said jogs, wherein one end portion of each rail is weakened at points intermediate a plurality of spaced detents whereby portions of the rails may be broken away to shorten the latter, and wherein the cross members are telescopic and comprise mutually slidable bars integral with each of the associated spaced legs, one of said bars entering a socket secured to the other bar and being capable of assuming at least two different detented relationships to the latter whereby to vary the width of the frame.

2. A frame according to claim 1, wherein a plurality of detents are formed at both ends of the longitudinal rails, the spacing between the detents being different at the two ends.

* * * * *